US008574011B2

(12) United States Patent
Shih

(10) Patent No.: US 8,574,011 B2
(45) Date of Patent: Nov. 5, 2013

(54) ELECTRONIC CONNECTOR

(75) Inventor: Wen Shuan Shih, New Taipei (TW)

(73) Assignee: Chant Sincere Co., Ltd., New Taipei (TW)

( * ) Notice: Subject to any disclaimer, the term of this patent is extended or adjusted under 35 U.S.C. 154(b) by 66 days.

(21) Appl. No.: 13/407,779

(22) Filed: Feb. 29, 2012

(65) Prior Publication Data

US 2012/0270443 A1 Oct. 25, 2012

(51) Int. Cl.
*H01R 24/00* (2011.01)

(52) U.S. Cl.
USPC ..... 439/660

(58) Field of Classification Search
USPC ..... 439/660, 218
See application file for complete search history.

(56) References Cited

U.S. PATENT DOCUMENTS 7,938,659 B1 * 5/2011 Zhu et al. ..... 439/218
8,100,724 B2 * 1/2012 Lin et al. ..... 439/630
8,109,795 B2 * 2/2012 Lin et al. ..... 439/660
8,382,519 B2 * 2/2013 Lin et al. ..... 439/607.01
8,393,920 B2 * 3/2013 Yu et al. ..... 439/660
2010/0248552 A1 * 9/2010 He et al. ..... 439/638
2010/0255702 A1 * 10/2010 Lin et al. ..... 439/218
2011/0092107 A1 * 4/2011 Nomiyama et al. ..... 439/660
2011/0159746 A1 * 6/2011 He ..... 439/660

* cited by examiner

*Primary Examiner* — Gary F. Paumen
(74) *Attorney, Agent, or Firm* — Leong C. Lei

(57) ABSTRACT

An electronic connector comprises an insulated housing, a first terminal pin set, a second terminal pin set, a third terminal pin set, a detective terminal pin and a metal shell. The insulated housing contains a base plate and defines a first space and a second space. The first, second and third terminal pin sets are located in the first and second spaces and work together to conform to the standards of USB 2.0 and 3.0. The detective terminal pin is disposed on an inner surface defining the first space. The metal shell encases the insulated housing and is electrically grounded. Thereby, when an interface is reversely inserted into the first space, the detective terminal pin can be electrically grounded. Such manner will allow the terminal pin sets to be selectively activated or deactivated according to the way of insertion of the interface into the connector to achieve a reliable communication.

12 Claims, 12 Drawing Sheets

ELECTRONIC CONNECTOR

TECHNICAL FIELD OF THE INVENTION

The present invention relates to an electronic connector and, more particularly, to a connector that can provide at least two specifications for external communication interfaces, in which a detective terminal pin is provided and can be electrically grounded according to the way of insertion of an external communication interface into the connector, so that the terminal pin sets of the connector can be selectively activated or deactivated so that an accurate and reliable communication can be achieved.

DESCRIPTION OF THE PRIOR ART

Due to advances in technology, electronic products have opened the door of the world's knowledge and thus are indispensable in people's daily lives. According to the demand of market, the electronic products are being developed in the tendency of light, thin, short, and small, which will make the external connectors of an electronic product necessary be more compact than ever in addition to a reduction of its internal space.

Among the existing electronic products, Universal Serial Bus (USB) is the most popular specification for communication between devices. A connector implementing the specification of USB can be applied in various peripheral devices for computers, such as mouse, printers, flash drives, etc. To achieve the purpose of transferring a large amount of data, the connectors of USB 2.0 have gradually insufficient for completing the task in short time, so that USB 3.0 has been developed and would be suitable for transferring a large amount of data in short time.

Since the number of terminal pins of USB 2.0 is different from that of USB 3.0, and the connectors of USB 2.0 cannot support the functions of USB 3.0, additional connectors of USB 3.0 should be purchased for a high speed transfer. To have a slim design of electronic products, the connectors of USB 2.0 and the connectors of USB 3.0 should be integrated into an integral connector that is more compact and simple in structure. Additionally, to obtain an easy, accurate and reliable communication, the way of insertion of external communication interfaces into connectors should include a normal insertion and a reverse insertion. The present invention can provide a solution for the above demands.

SUMMARY OF THE INVENTION

The primary object of the present invention is to provide an electronic connector that can provide an easy, accurate, and reliable way of communication.

According to one aspect of the present invention, the electronic connector comprises an insulated housing, a first terminal pin set, a second terminal pin set, a third terminal pin set, a detective terminal pin, and a metal shell. The insulated housing contains a base plate at a front end thereof and defines a first space above the base plate and a second space below the base plate, in which the second space corresponds to the first space. The first terminal pin set, which conforms to the standard of USB 2.0, is located in the first space and may cooperate with the third terminal pin set to conform to the standard of USB 3.0. The second terminal pin set, which conforms to the standard of USB 2.0, is located in the second space and may cooperate with the third terminal pin set to conform to the standard of USB 3.0. The detective terminal pin is disposed in an inner surface that defines the first space. The metal shell encases the insulated housing and is electrically grounded. In use, an external communication interface can be normally inserted in the second space or reversely inserted into the first space. When the external communication interface is reversely inserted into the first space, the detective terminal pin can be urged by the interface to have it contacted with the metal shell and thus electrically grounded, so that a signal can be triggered to disable the second terminal pin set and enable the first terminal pin set. Such manner will allow the first terminal pin set or the second terminal pin set to be activated or deactivated according to the way of insertion of the external communication interface into the electronic connector to achieve an accurate and reliable communication According to another aspect of the present invention, the third terminal pin set includes five pieces of third front terminal pins and five pieces of third rear terminal pins corresponding to the third front terminal pins. The third rear terminal pins are disposed in the base plate of the insulated housing. Each of the third rear terminal pins has one end being formed as a contact portion for electrically connecting with one of the third front terminal pins and has another end being formed as an electrical connection leg. At least two of the third rear terminal pin may be each provided with a side plate extending upwardly or downwardly from the contact portion thereof to increase the longitudinal strength of the contact portion thereof, so that the contact portion can be prevented against a longitudinal deformation and the base plate can be strengthened.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
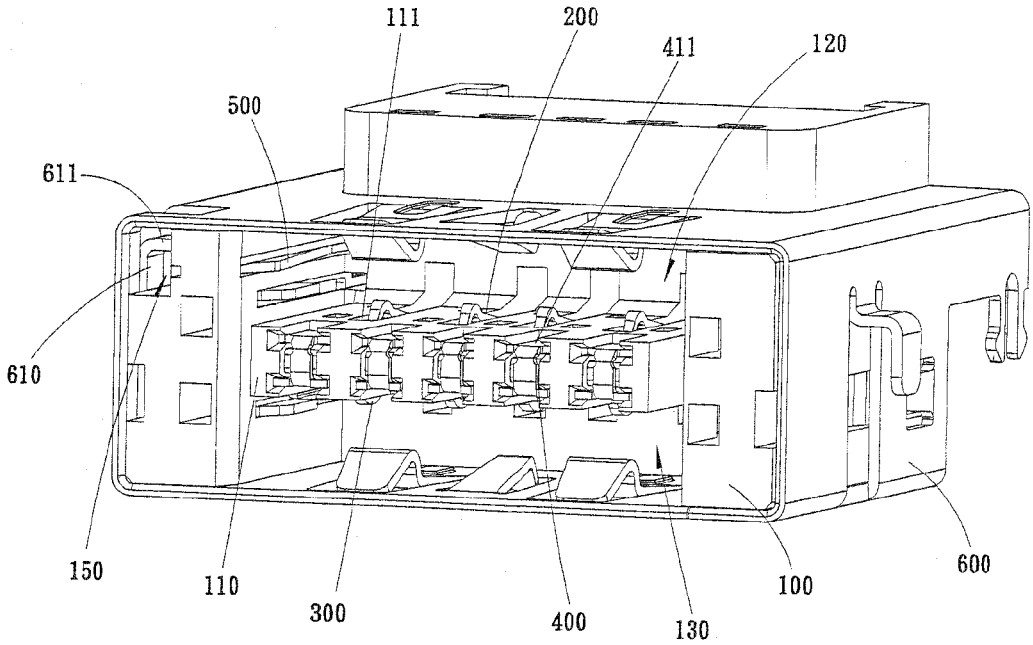
FIG. 1 is a 3-dimensional view of an electronic connector according to a first embodiment of the present invention.
Figure 2:
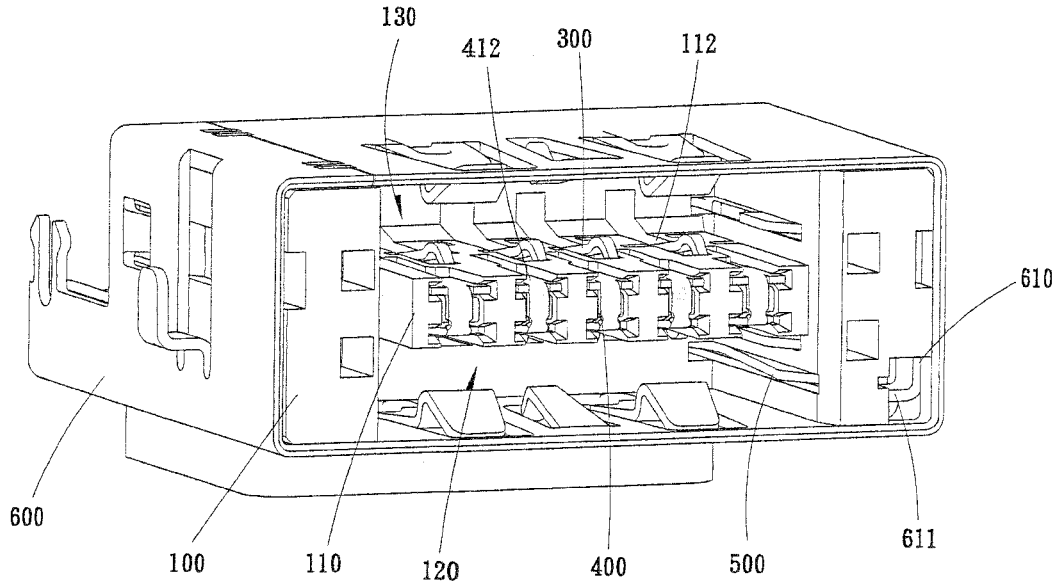
FIG. 2 is a 3-dimensional view of the first embodiment of the present invention, which is viewed from another angle.
Figure 3:
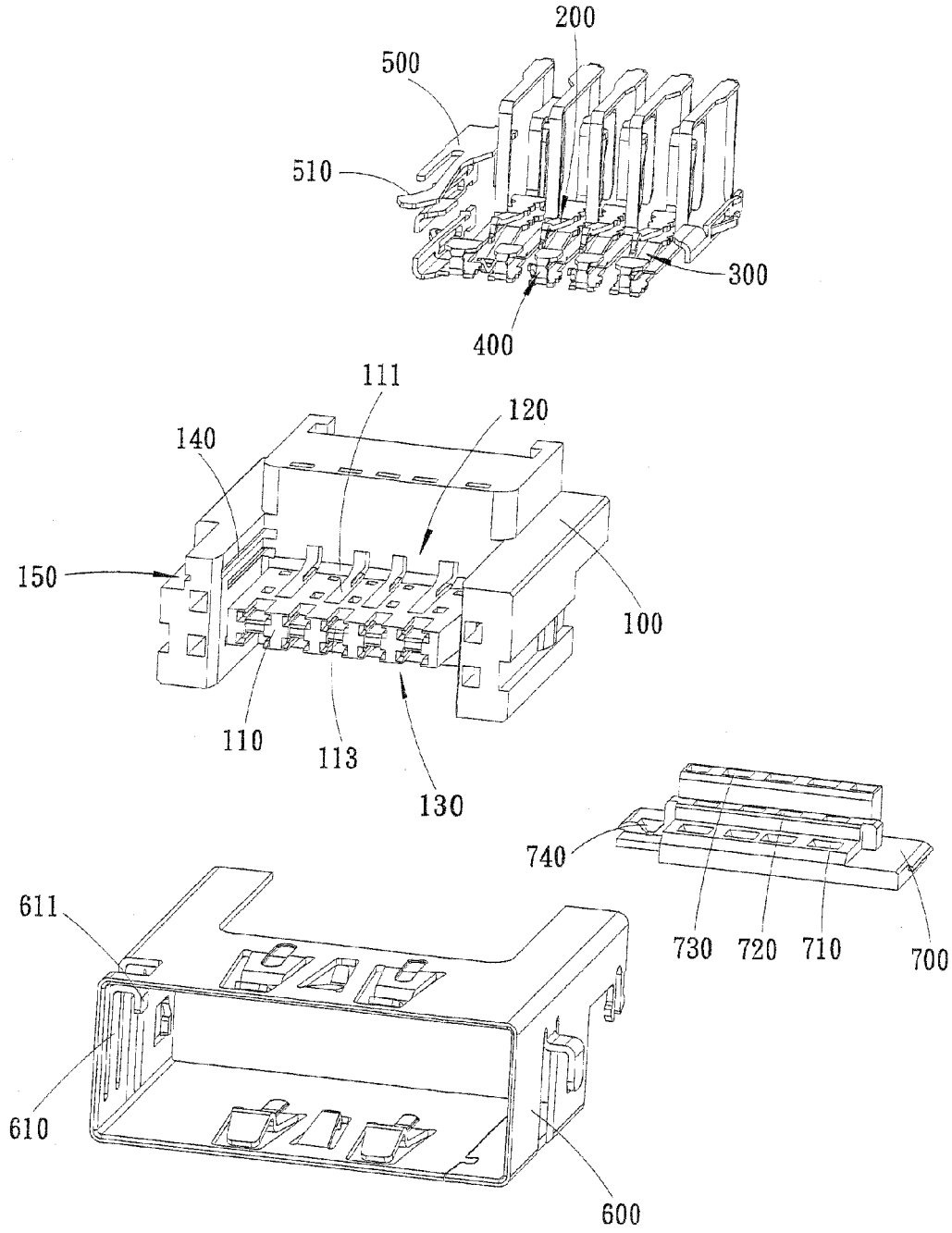
FIG. 3 is an exploded view of the first embodiment of the present invention.
Figure 4:
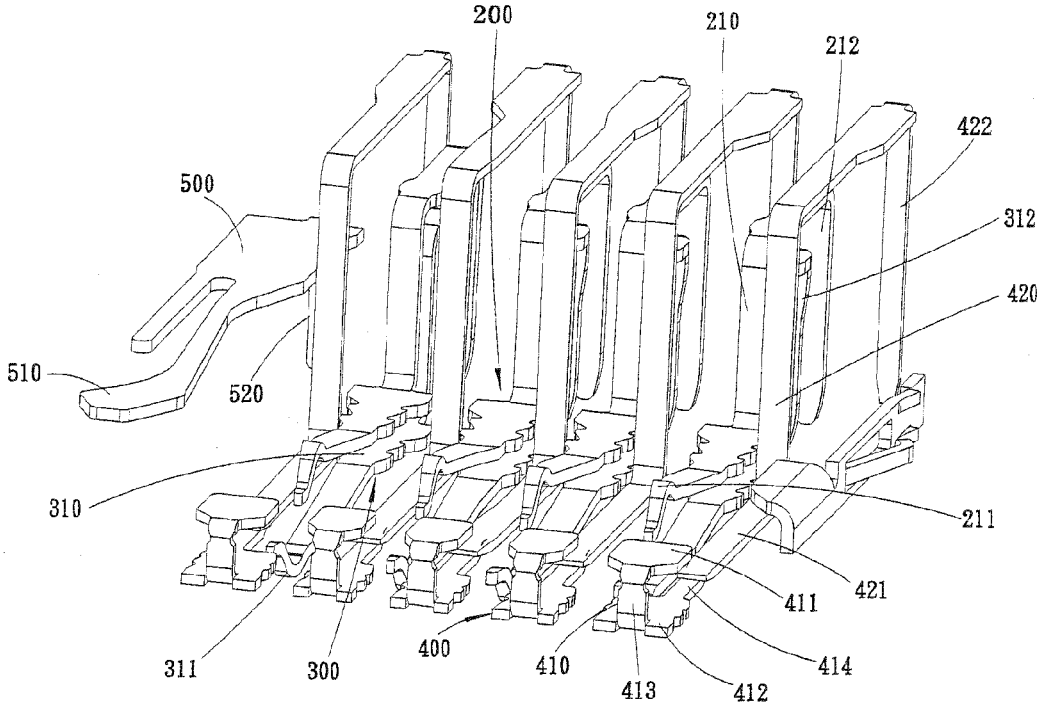
FIG. 4 is a 3-dimensional view of the first embodiment of the present invention, which shows the terminal pin sets thereof
Figure 5:
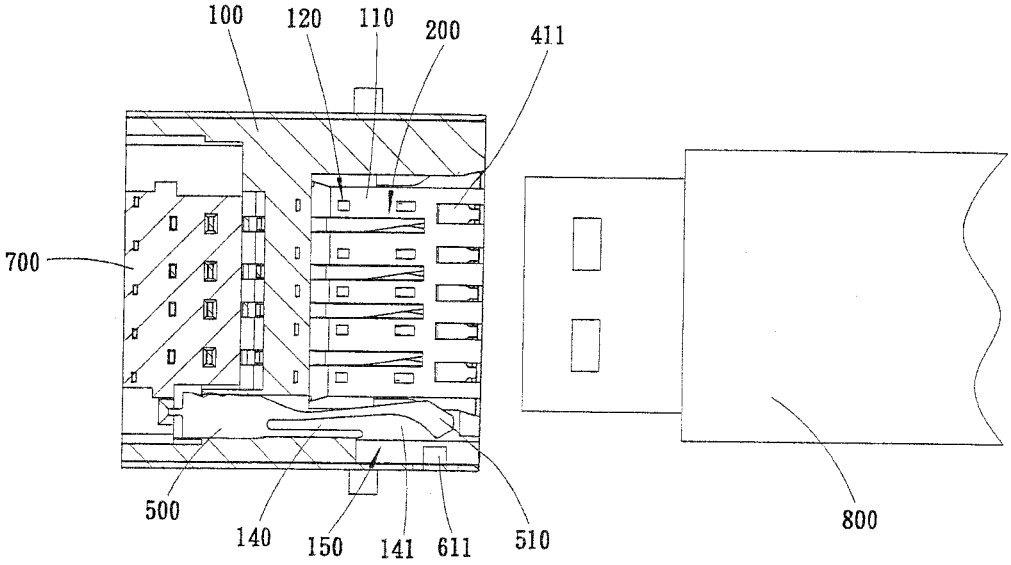
FIG. 5 is a sectional view of the first embodiment of the present invention, which illustrates a first state of operation thereof.
Figure 6:
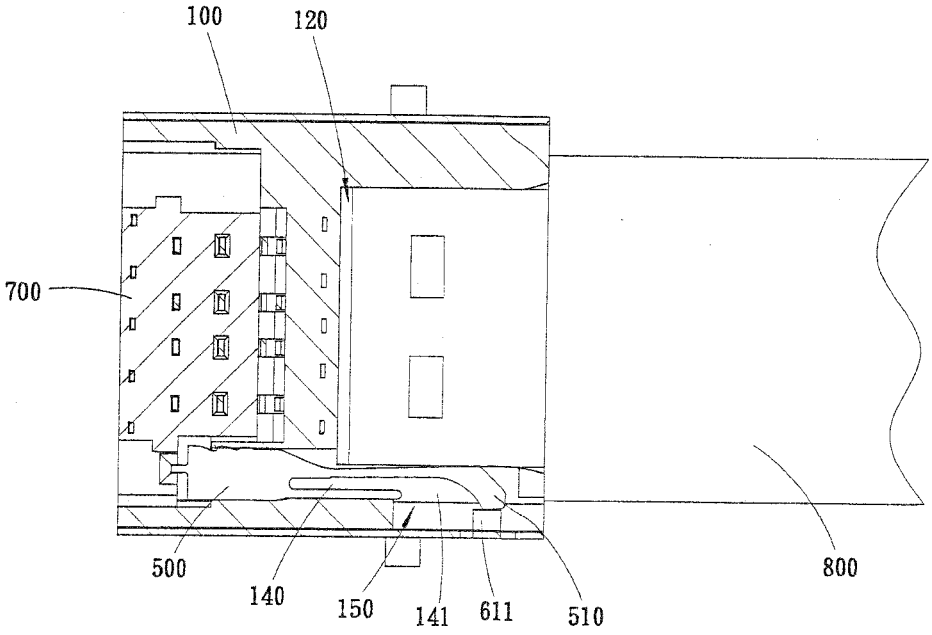
FIG. 6 is a sectional view of the first embodiment of the present invention, which illustrates a second state of operation thereof

Turning now to FIGS. 1-6, a first embodiment of an electronic connector according to the present invention is illustrated. The electronic connector comprises an insulated housing 100, a first terminal pin set 200, a second terminal pin set 300, a third terminal pin set 400, a detective terminal pin 500, and a metal shell 600. The insulated housing 100 contains a base plate 110 at a front end thereof and defines a first space 120 above the base plate 110 and a second space 130 below the base plate 110, in which the second space 130 corresponds to the first space 120. The base plate 110 defines a plurality of first recesses 111 on a top surface thereof and a plurality of second recesses 112 on a bottom surface thereof. The first recesses 111 and the second recesses 112 are located at a rear portion of the base plate 110, in which the first recesses 111 are located in the first space 120 whereas the second recesses 112 are located in the second space 130. Also, the base plate 10 defines a plurality of third recesses 113 respectively on the top surface and the bottom surface thereof. The third recesses 113 are located at a front portion of the base plate 110. Furthermore, the insulated housing 100 defines a fourth recess 140 on an inner surface thereof which defines the first space 120. The fourth recess 140 includes an opening 141. The insulated housing 100 further defines a cutout or accommodating space 150 on an outer surface thereof, which corresponds to and communicates with the opening 141 of the fourth recess 140.

The first terminal pin set 200 is disposed to the base plate 110 and located in the first space 120 of the insulated housing 100. The first terminal pin set 200 includes four pieces of first terminal pins 210, which are respectively disposed in the first recesses 111 of the base plate 110. The two outer pieces of the first terminal pins 210 are respectively served as a positive power source and a ground, whereas the two inner pieces of the first terminal pins 210 are respectively served as a signal-transmitting port and a signal-receiving port, so that the electronic connector may conform to the standard or specification of Universal Serial Bus, version 2.0 (USB 2.0). Each of the first terminal pins 210 has one end being formed as a contact portion 211 for electrically connecting with a corresponding terminal pin of an external communication interface and another end being formed as an electrical connection leg 212, which extends out of the insulated housing 100.

The second terminal pin set 300 is disposed to the base plate 110 and located in the second space 130 of the insulated housing 100. The second terminal pin set 300 includes four pieces of second terminal pins 310, which are respectively disposed in the second recesses 112 of the base plate 110. The two outer pieces of the second terminal pins 310 are respectively served as a positive power source and a ground, whereas the two inner pieces of the second terminal pins 310 are respectively served as a signal-transmitting port and a signal-receiving port, so that the electronic connector may conform to the standard or specification of Universal Serial Bus, version 2.0 (USB 2.0). Each of the second terminal pins 310 has one end being formed as a contact portion 311 for electrically connecting with a corresponding terminal pin of an external communication interface and another end being formed as an electrical connection leg 312, which extends out of the insulated housing 100.

Figure 11:
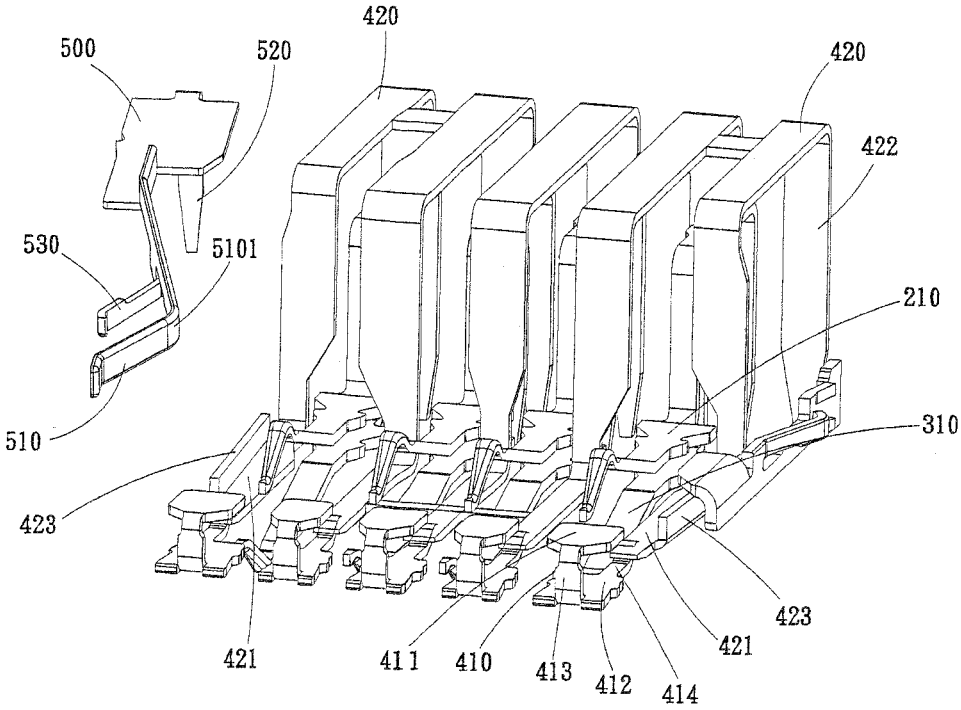
FIG. 11 is an exploded view of the third embodiment of the present invention, which shows the terminal pin sets thereof

The third terminal pin set 400 includes five pieces of third front terminal pins 410 and five pieces of third rear terminal pins 420 corresponding to the third front terminal pins 410. The middle piece of the third front terminal pins 410 is served as a ground, whereas the other four pieces of the third front terminal pins 410 are respectively served as a signal-transmitting differential pair and a signal-receiving differential pair. The third front terminal pins 410 are respectively disposed in the third recesses 113, which are located in the first space 120 and the second space 130 at the front portion of the base plate 110. Each of the third front terminal pins 410 is formed with a first contact portion 411, a second contact portion 412, and a strip 413 between the first contact portion 411 and the second contact portion 412. The first contact portion 411 and the second contact portion 412 are used for electrically connecting with an external communication interface. Also, the first contact portion 411 is electrically connected with the second contact portion 412 by the strip 413. The first contact portions 411 of the third front terminal pins 410 are located in the first space 120 of the insulated housing 100, whereas the second contact portions 412 of the third front terminal pins 410 are located in the second space 130 of the insulated housing 100. The third rear terminal pins 412 are disposed in the insulating housing 100 and the base plate 110. Each of the third rear terminal pins 412 has one end being formed as a contact portion 421 for electrically connecting with one of the third front terminal pins 410 and has another end being formed as an electrical connection leg 422, which extends out of the insulated housing 100. Furthermore, in the electronic connector, at least two pieces of the third rear terminal pins 420 can be each provided with a side plate, which extends upwardly or downwardly from the corresponding contact portion 421 thereof. For example, as shown in FIG. 11, the two outer pieces of the third rear terminal pins 420 may be each provided with a side plate 423 extending upwardly to increase the strength of the contact portion 421 of the third rear terminal pin 420 so that the contact portion 421 of the third rear terminal pin 420 can be prevented against longitudinal deformation.

A detective terminal pin 500 is disposed in the fourth recess 400. The detective terminal pin 500 has a detection arm 510 extending from one end thereof and an electrical connection leg 520 formed at another end thereof. The detection arm 510 is constructed with flexibility that allows it to be restored to its original shape. The free end of the detection arm 510 is bent toward the opening 141 of the fourth recess 140 in the first space 120 of the insulated housing 100. The detection arm 510 of the detective terminal pin 500 can extend through the fourth recess 140 into the first space 120 when it is not urged by external force. The detection aim 510 of the detective terminal pin 500 can move through the opening 141 of the fourth recess 140 into the cutout or accommodating space 150 when it is urged by external force The metal shell 600 encases the insulated housing 100. The metal shell 600 is provided with an engagement arm 610 at a lateral side thereof corresponding to the detective terminal pin 500, in which the engagement arm 610 has one end connected with the metal shell 600 and another end bent with a contact portion 611 within the cutout or accommodating space 150 of the insulated housing 100.

The above-mentioned electrical connection legs 212, 312, 422 and 520 can extend out of the insulated housing 100 so as to be electrically connected with an external circuit board (not shown). Furthermore, each of the third front terminal pins 410 can be formed with an electrical connection leg 414 extending from the second contact portion 412 thereof to be electrically connect with the contact portion 421 of one of the third rear terminal pins 420, so that the first contact portion 411 and the second contact portion 412 of each of the third front terminal pin 410 can be electrically connected with the external circuit board. Also, the contact portion 421 of each of the third rear terminal pins 420 can be electrically connected with the first contact portion 411 and the second contact portion 412 of one of the third front terminal pins 410.

According to the present invention, the first terminal pin set 200, which conforms to the standard or specification of USB 2.0 and is located in the first space 120 of the insulated housing 100, may cooperate with the first contact portions 411 of the third terminal pin set 400, which includes 5 pieces of the third front terminal pins 410, to thereby conform to the standard or specification of USB 3.0. In addition, the second terminal pin set 300, which conforms to the standard or specification of USB 2.0 and is located in the second space 130 of the insulated housing 100, may cooperate with the second contact portions 412 of the third terminal pin set 400, which includes 5 pieces of the third front terminal pins 410, to thereby conform to the standard or specification of USB 3.0. Therefore, the electronic connector can provide two specifications for external communication interfaces, each of which can be inserted in the upper space (i.e. the first space 120) or in the lower space (i.e. the second space 130) of the electronic connector. That is to say, an external communication interface, which conforms to the standard of USB 2.0 or 3.0, can be inserted into the electronic connector in a normal way or reverse way. For example, when an external communication interface 800 conforming to the specification of USB 2.0 or 3.0 is normally inserted into the electronic connector, the terminal pins of the external communication interface 800 can be electrically connected with the second terminal pin set 300 in the second space 130 of the insulated housing 100 or both of the second terminal pin set 300 and the second contact portions 412 of the third terminal pin set 400. On the other hand, when an external communication interface 800 conforming to the specification of USB 2.0 or 3.0 is reversely inserted into the electronic connector; the terminal pins of the external communication interface 800 can be electrically connected with the first terminal pin set 200 in the first space 120 of the insulated housing 100 or both of the first terminal pin set 200 and the first contact portions 411 of the third terminal pin set 400.

It is noted that, when the metal shell 600 is electrically grounded and a special communication interface 800, such as a thin USB port or an unshielded USB port, is normally inserted into the electronic connector (see FIG. 6), the terminal pins of the interface 800 can be electrically connected with the second terminal pin set 300 in the second space 130 of the insulated housing 100. On the other hand, when the interface 800 is reversely inserted into the electronic connector, the terminal pins of the interface 800 can be electrically connected with the first terminal pin set 200 in the first space 120 of the insulated housing 100. At the same time, the detection arm 510 of the detective terminal pin 500 can be urged by external force from the interface 800 to move through the opening 141 of the fourth recess 140 and enter the cutout or accommodating space 150 to contact with the contact portion 611 of the metal shell 600, so that the detective terminal pin 500 can be electrically grounded and thus a signal can be triggered to allow a control processor on the circuit board to disable the second terminal pin set 300 and enable the first terminal pin set 200. Such manner will allow the first terminal pin set 200 in the first space 120 or the second terminal pin set 300 in the second space 130 to be selectively activated or deactivated according the way of insertion of the interface 800 into the electronic connector, a normal way or a reverse way, to obtain an accurate and reliable communication.

Turning now to FIG. 11, as mentioned above, the contact portions 421 of the third rear terminal pins 420 may be each provided with a side plate 423 extending upwardly or downwardly to increase the strength of the contact portions 421, so that the contact portions 421 can be prevent against longitudinal deformation. For example, the two outer pieces of the contact portions 421 of the third rear terminal pins 420 may have a length greater than the other pieces of the contact portions 421 of the third rear terminal pins 420 and are each provided with the side plate 423, in which the contact portions 421 and the side plates 423 associated therewith are located in the insulated housing 100 and the base plate 110. This feature may increase the longitudinal strength of the contact portions 421, thereby enhancing the strength of the base plate 110.

Furthermore, the electronic connector may be provided with a socket 700, which can be mounted at a rear portion of the insulating housing 100. The socket 700 defines a plurality of first holes 710, a plurality of second holes 720, a plurality of third holes 730, and a fourth hole 740, in which the first holes 710 can be respectively inserted with the electrical connection legs 312 of the second terminal pin set 300, the second holes 720 can be respectively inserted with the electrical connection legs 212 of the first terminal pin set 200, the third holes 730 can be respectively inserted with the electrical connection legs 422 of the third rear terminal pins 420 of the third terminal pin set 400, and the fourth hole 740 can be inserted with the electrical connection leg 520 of the detective terminal pin 500, so that the first terminal pin set 200, the second terminal pin set 300, the third terminal pin set 400, and the detective terminal pin 500 can be securely mounted in the insulated housing 100.

Figure 7:
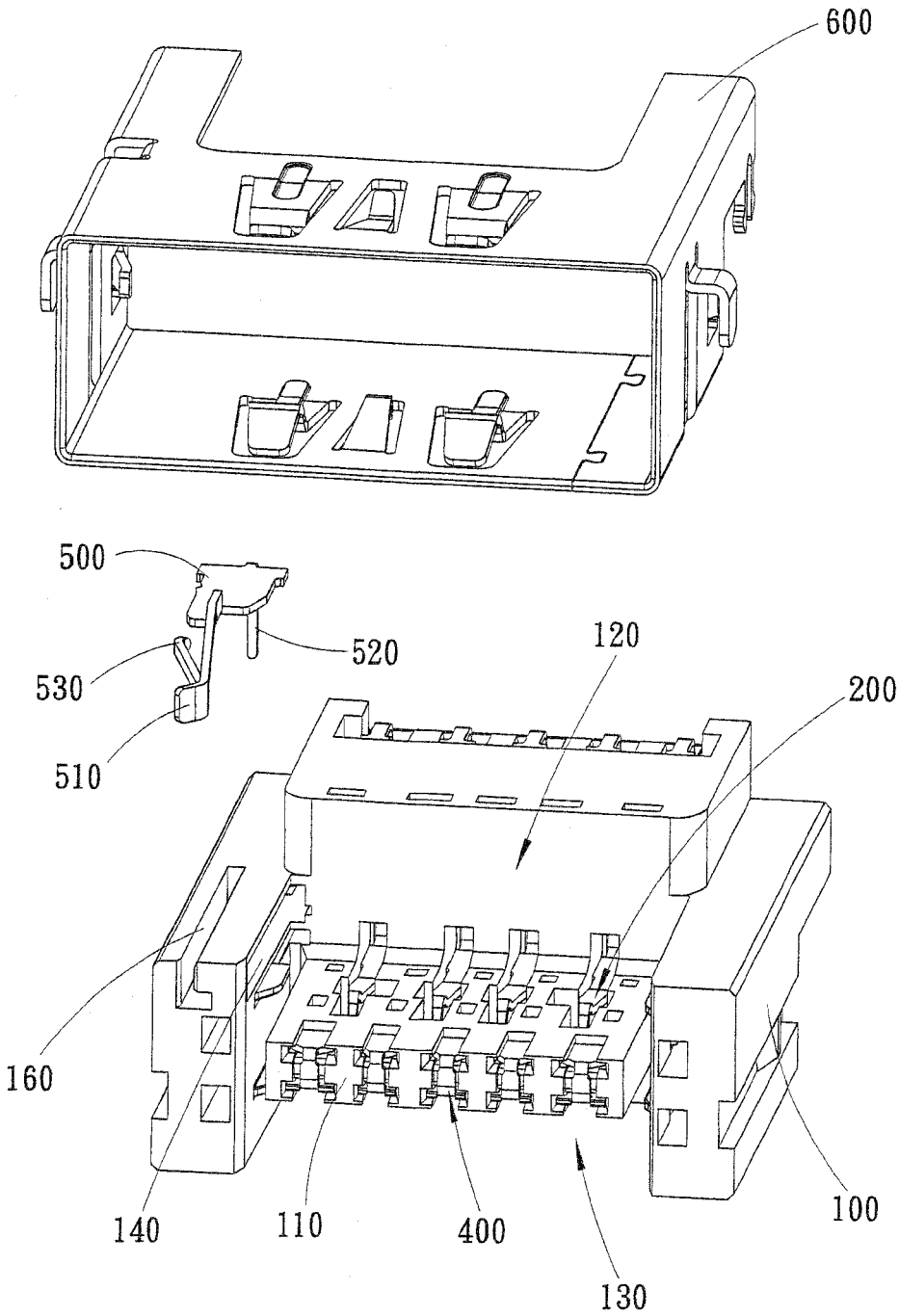
FIG. 7 is an exploded view of an electronic connector according to a second embodiment of the present invention.
Figure 8:
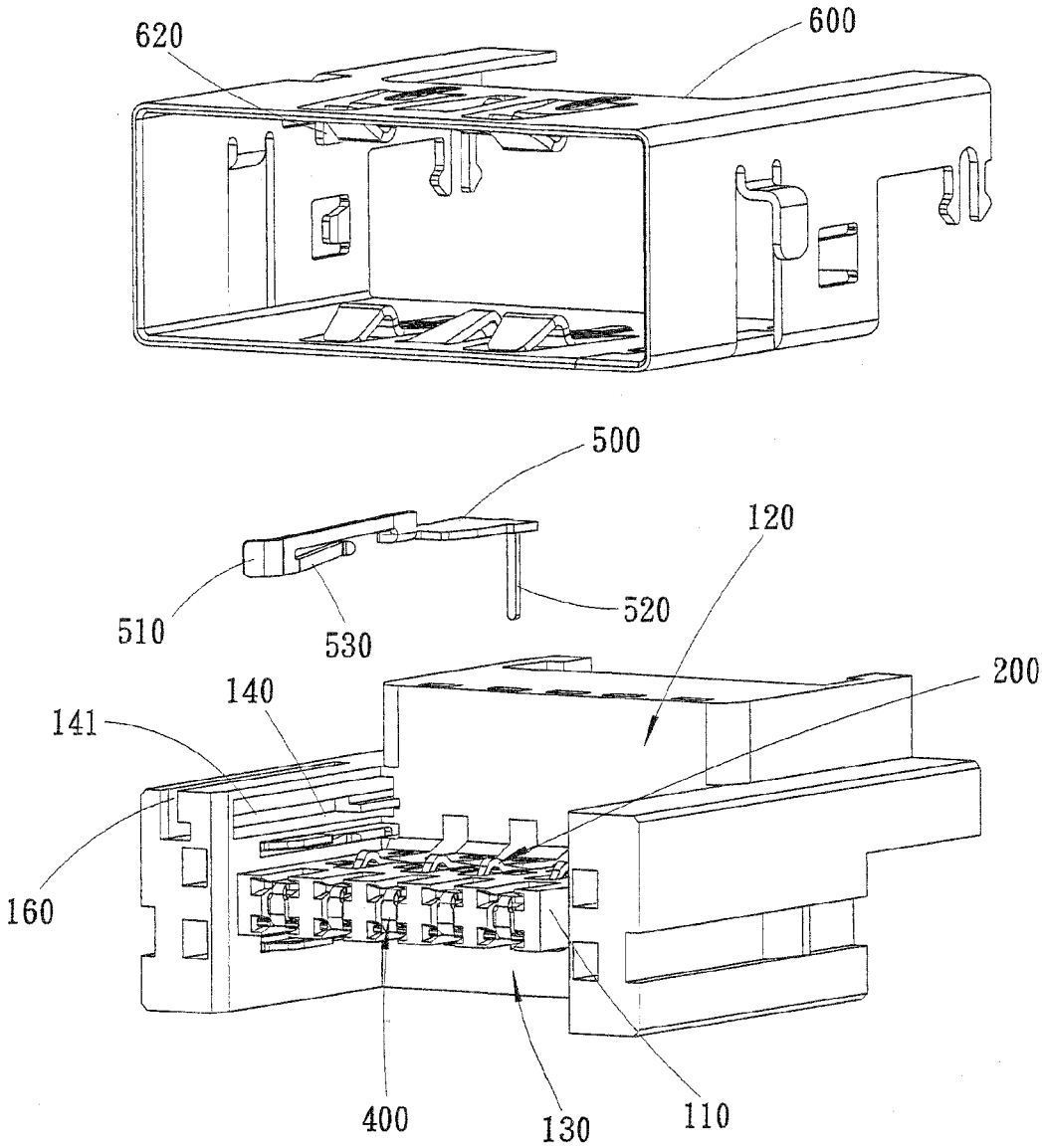
FIG. 8 is an exploded view of the second embodiment of the present invention, which is viewed from another angle.
Figure 9:
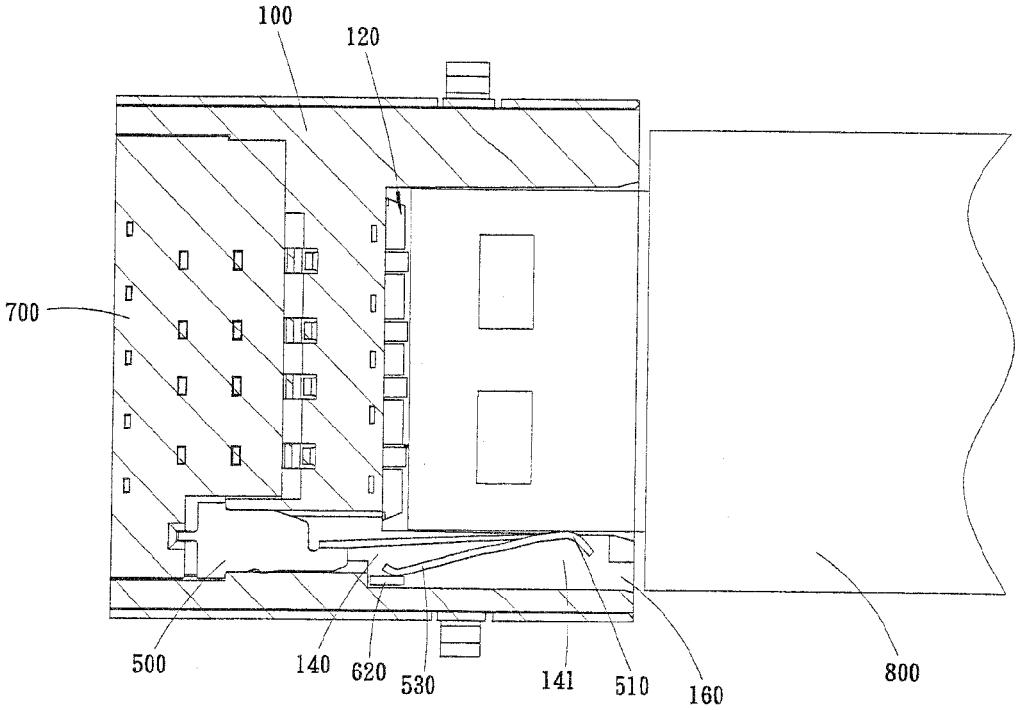
FIG. 9 is a sectional view of the second embodiment of the present invention, which illustrates a state of operation thereof

Turning now to FIGS. 7-9, a second embodiment of the electronic connector is illustrated, in which the insulated housing 100 defines a fifth recess 160 instead of the cutout or accommodating space 150 mentioned in the first embodiment. The fifth recess 160 corresponds to and communicates with the opening 141 of the fourth recess 140. A detective terminal pin 500 is disposed in the fourth recess 140. The detective terminal pin 500 has a detection arm 510 extending from one end thereof and an electrical connection leg 520 formed at another end thereof, in which the detection arm 510 has a contact arm 530 extending from its end. The contact arm 530 is located in the fourth recess 140 and the opening 141 of the fourth recess 140. Thereby, the detection arm 510 of the detective terminal pin 500 can extend through the fourth recess 140 into the first space 120 when it is not urged by external force; the detection arm 510 of the detective terminal pin 500 can move through the opening 141 of the fourth recess 141 into the fifth recess 160 when it is urged by external force. Furthermore, the metal shell 600 is provided with a contact plate 620 at a top side thereof. The contact plate 620 is located within the fifth recess 160 of the insulated housing 100 and corresponds to the contact arm 530 of the detective terminal pin 500. Accordingly, as shown in FIG. 9, when the metal shell 600 is grounded and a special communication interface 800, such as a thin USB port or an unshielded USB port, is reversely inserted into the electronic connector, the terminal pins of the interface 800 can be electrically connected with the first terminal pin set 200 in the first space 120 of the insulated housing 100. At the same time, the detection arm 510 of the detective terminal pin 500 can be urged by the external force from the interface 800, so that the contact arm 530 can move through the opening 141 of the fourth recess 140 into the fifth recess 160 to contact with the contact plate 620 of the metal shell 600, so that the detective terminal pin 500 can be electrically grounded, and thus a signal can be triggered and sent to a control processor on the circuit board to disable the second terminal pin set 300 and enable the first terminal pin set 200. Such manner will allow the first terminal pin set 200 in the first space 120 or the second terminal pin set 300 in the second space 130 to be selectively activated or deactivated according to the way of insertion of the interface 800 into the electronic connector, a normal way or a reverse way, to obtain an accurate and reliable communication.

Figure 10:
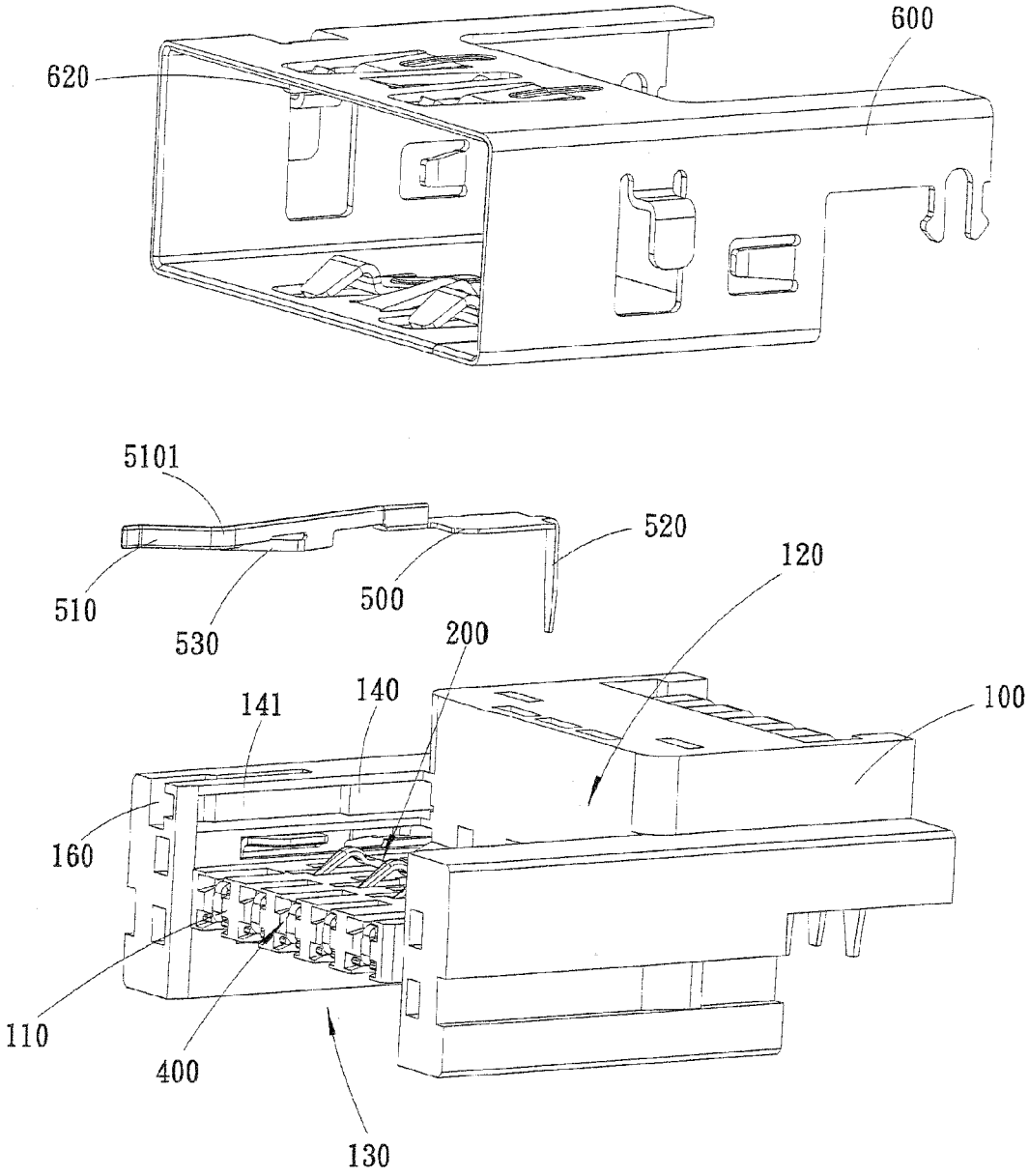
FIG. 10 is an exploded view of an electronic connector according to a third embodiment of the present invention.
Figure 12:
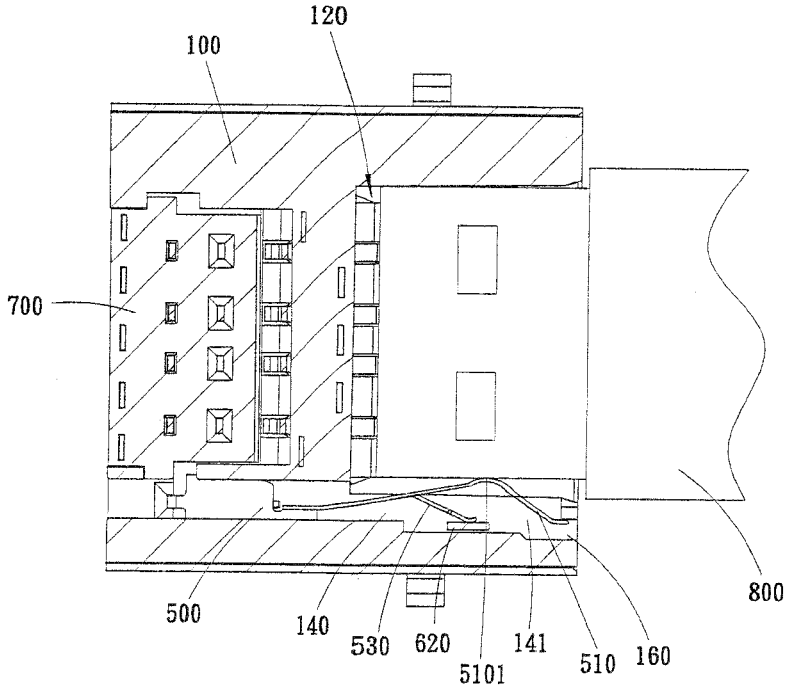
FIG. 12 is a sectional view of the third embodiment of the present invention, which illustrates a state of operation thereof.

Turning now to FIGS. 10-12, a third embodiment of the electronic connector is illustrated, in which the insulated housing 100 defines a fifth recess 160 instead of the cutout or accommodating space 150 mentioned in the first embodiment. The fifth recess 160 corresponds to and communicates with the opening 141 of the fourth recess 140. A detective terminal pin 500 is disposed in the fourth recess 140. The detective terminal pin 500 has a detection arm 510 extending from one end thereof and an electrical connection leg 520 formed at another end thereof; in which the detection arm 510 has an engagement portion 5101 being bent toward the first space 120 and a contact arm 530 extending opposite to the engagement portion 5101 in the fourth recess 140 and the opening 141. Thereby, the engagement portion 5101 of the detection arm 510 of the detective terminal pin 500 can extend through the fourth recess 140 into the first space 120 when it is not urged by external force; the engagement portion 5101 of the detection arm 510 of the terminal pin 500 can move together with the contact arm 530 when it is urged by external force, so that the contact arm 530 can move through the opening 141 of the fourth recess 140 into the fifth recess 160 by the external force. Furthermore, the metal shell 600 is provided with a contact plate 620 at a top side thereof. The contact plate 620 is located within the fifth recess 160 of the insulated housing 100 and corresponds to the contact arm 530 of the detective terminal pin 500. Accordingly, as shown in FIG. 12, when the metal shell 600 is grounded and a special communication interface 800, such as a thin USB port or an unshielded USB port, is reversely inserted into the electronic connector, the terminal pins of the interface 800 can be electrically connected with the first terminal pin set 200 in the first space 120 of the insulated housing 100. At the same time, the engagement portion 5101 of the detection arm 510 of the detective terminal pin 500 can be urged by the external force exerted from the interface 800, so that the contact arm 530 can move through the opening 141 of the fourth recess 140 into the fifth recess 160 to contact with the contact plate 620 of the metal shell 600, so that the detective terminal pin 500 can be electrically grounded, and thus a signal can be triggered and sent to a control processor on the circuit board to disable the second terminal pin set 300 and enable the first terminal pin set 200. Such manner will allow the first terminal pin set 200 in the first space 120 or the second terminal pin set 300 in the second space 130 to be selectively activated or deactivated according to the way of insertion of the interface 800 into the electronic connector, a normal way or a reverse way, to obtain an accurate and reliable communication.

In light of the foregoing, the present invention can provide at least two specifications for external communication interfaces conforming to one of the specifications. When an external communication interface is normally inserted into the electronic connector, the terminal pins of the external communication interface will be located in the second space 130 of the insulated housing 100, and thus will be electrically connected with the second terminal pin set 300 or both of the second terminal pin set 300 and the second contact portions 412 of the third terminal pin set 400. On the other hand, when the external communication interface is reversely inserted into the electronic connector, the terminal pins of the external communication interface will be located in the first space 120 of the insulated housing 100, and thus will be electrically connected with the first terminal pin set 200 or both of the first terminal pin set 200 and the first contact portions 411 of the third terminal pin set 400. Also, the detective terminal pin 500 can be flexibly bent by the external force exerted from the communication interface to allow the detective terminal pin 500 to be electrically grounded, so that a signal can be triggered and sent to the control processor on the circuit board, so that the first terminal pin set 200 in the first space 120 or the second terminal pin set 300 in the second space 130 can be selectively activated or deactivated according to the way of insertion of the interface 800 into the electronic connector, a normal way or a reverse way, to obtain an accurate and reliably communication. Thus, the present electronic connector can provide an easy, accurate and reliable way of communication.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. An electronic connector capable of providing at least two specifications for external communication interfaces, the electronic connector comprising:

an insulated housing containing a base plate at a front end thereof and defining a first space above said base plate and a second space below said base plate, said second space corresponding to said first space;

a first terminal pin set disposed to said base plate of said insulated housing and located in said first space of said insulated housing, said first terminal pin set including four pieces of first terminal pins, each of which has one end being formed as a contact portion for electrically connecting with a corresponding terminal pin of an external communication interface and has another end being formed as an electrical connection leg;

a second terminal pin set disposed to said base plate of said insulated housing and located in said second space of said insulated housing, said second terminal pin set including four pieces of second terminal pins, each of which has one end being formed as a contact portion for electrically connecting with a corresponding terminal pin of an external communication interface and has another end being formed as an electrical connection leg;

a third terminal pin set including five pieces of third front terminal pins and five pieces of third rear terminal pins corresponding to said third front terminal pins, said third front terminal pins being disposed to a front portion of said base plate and located in said first and second spaces, said third rear terminal pins being disposed in said base plate of said insulated housing, each of said third rear terminal pins having one end being formed as a contact portion for electrically connecting with one of said third front terminal pins and having another end being formed as an electrical connection leg; and a metal shell encasing said insulated housing and being electrically grounded.

2. The electronic connector of claim 1, wherein the two outer pieces of said first terminal pins are respectively served as a positive power source and a ground, whereas the two inner pieces of said first terminal pins are respectively served as a signal-transmitting port and a signal-receiving port.

3. The electronic connector of claim 1, wherein the two outer pieces of said second terminal pins are served as a positive power source and a ground, whereas the two inner pieces of said second terminal pins are respectively served as a signal-transmitting port and a signal-receiving port.

4. The electronic connector of claim 1, wherein the middle piece of said third front terminal pins is served as a ground, whereas the other four pieces of said third front terminal pins are respectively served as a signal-transmitting differential pair and a signal-receiving differential pair, and wherein each of said third front terminal pins is provided with a first contact portion, a second contact portion, and a strip between said first contact portion and said second contact portion, said first contact portion and said second contact portion being used for electrically connecting with an external communication interface, said first contact portion being electrically connected with said second contact portion by said strip, said first contact portion being located in said first space of said insulated housing whereas said second contact portion being located in said second space of said insulated housing, whereby said first terminal pin set may cooperate with said first contact portions of said third front terminal pins of said third terminal pin set to conform to the standard of USB, whereas said second terminal pin set may cooperate with said second contact portions of said third front terminal pins of the third terminal pin set to conform to the standard of USB.

5. The electronic connector of claim 1, wherein at least two pieces of said third rear terminal pins of said third terminal pin set are each provided with a side plate extending upwardly or downwardly from the corresponding contact portion thereof, the contact portions and the side plates associated therewith are located in said insulated housing and said base plate.

6. The electronic connector of claim 1, wherein said base plate defines a plurality of first recesses on a top surface thereof and a plurality of second recesses on a bottom surface thereof and a plurality of third recesses on both of the top and bottom surfaces at a front portion thereof; wherein said first recesses are located in said first space, said second recess are located in said second space, said first terminal pins of said first terminal pin set are respectively disposed in said first recesses, said second terminal pins of said second terminal pin set are respectively disposed in said second recesses, said third front terminal pins of said third terminal pin set are respectively disposed in said third recesses.

7. The electronic connector of claim 1, wherein said insulated housing defines a fourth recess on a wall that defines said first space, said fourth recess including an opening, said insulated housing defines a fifth recess corresponding to and communicating with said opening of said fourth recess, the electronic connector further comprises a detective terminal pin being disposed in said fourth recess, said detective terminal pin having a detection arm extending from one end thereof and having an electrical connection leg formed at another end thereof; said detection arm having an engagement portion being bent toward said first space, said detection arm having a contact arm extending opposite to said engagement portion, said metal shell being provided with a contact plate within said fifth recess of said insulated housing corresponding to said contact arm of said detective terminal pin, whereby said engagement portion of said detection arm of said detective terminal pin can extend through said fourth recess into said first space when it is not urged by external force, said engagement portion of said detection arm of said detective terminal pin can move through said opening of said fourth recess into said fifth recess when it is urged by external force.

8. The electronic connector of claim 7, wherein said contact plate of said metal shell may contact with said contact arm within said fifth recess of said insulated housing to allow said detective terminal pin to be electrically grounded.

9. The electronic connector of claim 1, wherein said insulated housing defines a fourth recess on a wall that defines said first space, said fourth recess including an opening, said insulated housing defines a fifth recess corresponding to and communicating with said opening of said fourth recess, the electronic connector further comprises a detective terminal pin being disposed in said fourth recess, said detective terminal pin having a detection arm extending from one end thereof, said detective terminal pin having an electrical connection leg formed at another end thereof, said detection arm having a contact arm extending from its end, said metal shell being provided with a contact plate within said fifth recess of said insulated housing corresponding to said contact arm of said detective terminal pin, whereby said detection arm of said detective terminal pin can extend through said fourth recess into said first space when it is not urged by external force, said detection arm of said detective terminal pin can move through said opening of said fourth recess into said fifth recess when it is urged by external force.

10. The electronic connector of claim 9, wherein said contact plate of said metal shell may contact with said contact arm within said fifth recess of said insulated housing to allow said detective terminal pin to be electrically grounded.

11. The electronic connector of claim 1, wherein said insulated housing defines a fourth recess on a wall that defines said first space, said fourth recess including an opening, said insulated housing defines an accommodating space corresponding to and communicating with said opening of said fourth recess, the electronic connector further comprise a detective terminal pin being disposed in said fourth recess, said detective terminal pin having a detection arm extending from one end thereof, said detective terminal pin having an electrical connection leg formed at another end thereof, said metal shell being provided with an engagement arm corresponding to said detective terminal pin, said engagement arm having one end connected with said metal shell and having another end formed with a contact portion within said accommodating space of said insulated housing, whereby said detection arm of said detective terminal pin can extend through said fourth recess into said first space when it is not urged by external force, said detection arm of said detective terminal pin can move through said opening of said fourth recess into said accommodating space when it is urged by external force.

12. The electronic connector of claim 11, wherein said contact portion of said engagement arm of said metal shell may contact with said detection arm within said accommodating space of said insulated housing to allow said detective terminal pin to be electrically grounded.

* * * * *